US005234644A

United States Patent [19]

Schütze et al.

[11] Patent Number: 5,234,644

[45] Date of Patent: Aug. 10, 1993

[54] PROCESS FOR PRODUCING ULTRA-HIGH MOLECULAR WEIGHT POLYAMIDE FIBERS

[75] Inventors: Gustav Schütze; Bernhard Stoll, both of Domat/Ems, Switzerland

[73] Assignee: Ems-Inventa AG, Switzerland

[21] Appl. No.: 750,831

[22] Filed: Aug. 27, 1991

[30] Foreign Application Priority Data

Aug. 27, 1990 [DE] Fed. Rep. of Germany ..... 4027063

[51] Int. Cl.[5] ..... D01D 10/02; D01F 11/04

[52] U.S. Cl. ..... 264/101; 264/137; 264/236; 427/350; 427/372.2

[58] Field of Search ..... 264/85, 101, 102, 136, 264/137, 236; 427/350, 372.2

[56] References Cited

U.S. PATENT DOCUMENTS 3,420,804 1/1969 Ramsey et al. .
4,419,400 12/1983 Hindersinn ..... 264/137 X
4,758,472 7/1988 Kitamura ..... 428/364

FOREIGN PATENT DOCUMENTS 98616 1/1984 European Pat. Off. .
51-27719 3/1976 Japan .
359286 2/1962 Switzerland .

*Primary Examiner*—Leo B. Tentoni
*Attorney, Agent, or Firm*—Bierman and Muserlian

[57] ABSTRACT

A process for producing ultra-high molecular weight polyamide fibers by thermal post condensation in the solid phase in the presence of catalysts of normally viscous polyamide fibers below their melting point in the absence of oxygen wherein the fibers have extremely high relative solution viscosities.

25 Claims, No Drawings

PROCESS FOR PRODUCING ULTRA-HIGH MOLECULAR WEIGHT POLYAMIDE FIBERS

This Application claims the priority of German 40 27 063.7, filed Aug. 27, 1990.

The invention relates to a process for producing ultra-high molecular weight polyamide fibers and polyamide fibers produced thereby.

BACKGROUND OF THE INVENTION

The so-called industrial polyamide fibers are used, among other things, for netting and ropes, conveyor belt cloth, industrial machinery felts, filters, fishing lines, industrial cloth, and anchoring wire as well as brushes. As aliphatic polyamides generally have good resistance to chemicals, they are eminently suitable for paper machinery webs. In addition to generally good mechanical properties such as high tensile strength, high bending strength and abrasion resistance are required of materials which are subject to bending. These properties are highly dependent on the molar mass of the polymer. The higher the degree of polymerization of the polymer, the more stable the fibers are to bending stress.

According to the prior art, to enable polyamide fibers having high molar masses to be produced, the polyamide granulate is subjected to solid phase condensation before being spun to fibers, as described, for example, in U.S. Pat. No. 3,420,804 or in EP-PS 98 616. A disadvantage of this procedure is that the high molecular weight spinning granulate has a very high melt viscosity and can therefore be spun only poorly owing to a high build-up of pressure upstream of the spinneret. Furthermore, an uncontrolled reduction of molar mass occurs in the melt of high molecular weight granulate during the spinning process.

CH-PS 359 286 describes a process for producing high molecular weight polyamide granulate by solid phase condensation in two steps. The solid phase condensation catalysts are incorporated into the melt of the polyamide starting material and the plastics parts obtained by injection molding or extrusion are then solid phased condensed. This mode of operation is unsuitable for the production of high molecular weight polyamide fibers as the catalysts incorporated trigger uncontrolled solid phase condensation in the hot polyamide spinning melt.

Japanese 27 719/76 describes the solid phase condensation of polyamide molded shapes immersed in catalyst solution to increase the service life of highly stressed shaped articles by converting the two-dimensional molecular structure into a three-dimensional one; in other words, the polyamide is crosslinked at its surface. However, crosslinked fibers in the surface layer possess marked disadvantages in coloration and resistance to failure under repeated bending stress. In contrast to the abstract, this reference does not mention fibers but shaped articles, such as a ring traveller and sash roller.

SUMMARY OF THE INVENTION

It is, therefore, the object of the invention to produce particularly high molecular weight, uncrosslinked polyamide fibers having a high repeated bending endurance and good abrasion resistance. In particular, the invention comprises a process for the solid phase condensation of melt-spun polyamide fibers in the presence of solid phase condensation catalysts and the fibers produced by this process. It has surprisingly been found that polyamide fibers can be so condensed in the solid phase without crosslinking and without exhibiting the disadvantageous properties in use expected from the prior art.

Normal viscosity polyamide fibers are those having relative solution viscosities in $H_2SO_4$ of about 4.2 maximum, preferably a maximum of 4.0, more preferably those in the viscosity ranges of about 3.4 to about 3.8, most preferably about 3.8. The relative solution viscosities are measured as a 1% solution in 98% sulphuric acid at 20° C. according to DIN 53727. They are produced from ω-aminocarboxylic acids or lactams containing 4 to 12 carbon atoms or mixtures thereof, but preferably PA 4, PA 6, PA 11 and PA 12, or from aliphatic diamines containing 4 to 12 carbon atoms and aliphatic dicarboxylic acids containing 5 to 12 carbon atoms or from mixtures thereof, but preferably PA 4.6, PA 6.6, PA 6.10 and PA 12.12.

Inorganic phosphorus compounds, preferably salts or esters of phosphorous acid or orthophosphoric acid or the free acids themselves are used as solid phase condensation catalysts. Especially preferable are $H_3PO_4$, $H_3PO_3$, $Na_2HPO_4.12H_2O$, $Na_2HPO_3.5H_2O$, and $NaH_2PO_4$.

The normal viscosity polyamide fibers are impregnated with catalyst in known manner; for example, in a liquor. The catalyst content, based on the fibers to be solid phase condensed, being 0.5% maximum, preferably 0.1 to 0.3%, most preferably about 0.2% (all percentages being by weight). The solid phase condensation is carried out at temperatures of 160° to 200° C., preferably 170° to 190° C., in an inert gas atmosphere or under vacuum for 5 to 48 hours, preferably 6 to 24 hours, most preferably 8 to 12 hours.

The process according to the invention has the following advantages:

1. It can be carried out batchwise, for example in a tumble dryer, or continuously using suitable conveying elements, for example in an inclined rotary tube dryer.

2. Particularly high molar masses with solution viscosities in $H_2SO_4$ of at least 7.0, preferably at least 9.0, can be achieved starting from normal-viscosity, preferably ordinary commercial polyamide fibers. Fibers with such extremely high viscosities cannot be spun by conventional processes.

3. Polyamide fibers having excellent abrasion resistance can be produced by the process of the invention and the number of wire abrasion turns can be increased by 200%. Fibers of uncrosslinked polyamide can be produced which are readily soluble and do not exhibit brittleness; i.e. the fibers have no impaired properties such as reduction of elongation at break. It can therefore be assumed that the increase achieved in the molar mass is achieved by further amide bonds in the polyamide and not by crosslinking.

The following examples illustrate embodiments of the invention without limiting it. The results of the tests are set out in Tables.

The results compiled in Tables 1 to 3 prove that an increase in the solution viscosity, which is a measure of the molar mass, and an increase in the wire abrasion turns, which is a measure of the abrasion resistance, are achieved by the solid phase condensation process of the invention without other desirable fiber properties such as titre, tensile strength at break, and elongation at break being adversely affected.

The PA fiber types mentioned in the Examples and Tables are:

Polymer 1. Grilon TM 26 R (EMS-CHEMIE AG Switzerland): a crimped polyamide 6 fiber having a relative solution viscosity of about 3.30–3.45.

Polymer 2. Grilon TM 26 2 R (EMS-CHEMIE AG/-Switzerland): a crimped polyamide 6 fiber having a relative solution viscosity of about 3.70–3.90.

Polymer 3. Grilon TM 26 high viscosity (EMS-CHEMIE AG/Switzerland): a crimped polyamide 6 fiber having a relative solution viscosity of about 4.45–4.60.

Polymer 4. Nylon/T 310 (DuPont/USA): a crimped polyamide 6.6 fiber having a relative solution viscosity of about 3.00–3.10.

All types of polyamide contain conventional commercial heat stabilizers of the Irganox type produced by Ciba-Geigy/Swotzerland, except Grilon TM 26 high viscosity.

EXAMPLE 1 (COMPARISON)

17 dtex polyamide (PA) 6 fibers of Polymer 1 having 11 crimps per cm and a relative solution viscosity of 3.36 are thermally solid phase condensed at 180° C. under vacuum for the times mentioned in Table 1 without catalyst.

EXAMPLE 2 (INVENTION)

17 dtex PA 6 fibers of the Polymer 1 with 11 crimps per cm and a relative solution viscosity of 3.36 are treated with an aqueous solution of orthophosphoric acid (fiber/water ratio 1:20) without wetting agent for 30 minutes at 95° C. The quantity of acid used is 0.2% by weight, based on the fibers to be solid phase condensed. After filtration and air drying, the thus impregnated lower viscosity PA 6 fibers are solid phase condensed at 180° C. under vacuum for the times mentioned in Table 1.

EXAMPLE 3 (INVENTION)

The process according to Example 2 using phosphorous acid.

EXAMPLE 4 (INVENTION)

The process according to Example 2 using $NaH_2PO_4$.

EXAMPLE 5 (COMPARISON)

The process according to Example 1 using fibers of Polymer 2 having a relative solution viscosity of 3.72.

EXAMPLE 6 (INVENTION)

The process according to Example 2 using fibers of Polymer 2 having a relative solution viscosity of 3.72 and phosphorous acid.

EXAMPLE 7 (INVENTION)

The process according to Example 6 using orthophosphoric acid in place of phosphorous acid.

EXAMPLE 8 (COMPARISON)

The process according to Example 1 using fibers of Polymer 2 having a relative solution viscosity of 3.86.

EXAMPLE 9 (INVENTION)

The process according to Example 2 using fibers of Polymer 2 having a relative solution viscosity of 3.86 and phosphorous acid.

EXAMPLE 10 (INVENTION)

The process according to Example 9 using orthophosphoric acid in place of phosphorous acid.

EXAMPLE 11 (COMPARISON)

The process according to Example 1 using fibers of Polymer 2 having a relative solution viscosity of 3.88.

EXAMPLE 12 (INVENTION)

The process according to Example 2 using fibers of Polymer 2 having a relative solution viscosity of 3.88 and phosphorous acid.

EXAMPLE 13 (INVENTION)

The process according to Example 12 using orthophosphoric acid in place of phosphorous acid.

EXAMPLE 14 (COMPARISON)

The process according to Example 1 using fibers of Polymer 2 having a relative solution viscosity of 3.85.

EXAMPLE 15 (INVENTION)

The process according to Example 2 using fibers of Polymer 2 having a relative solution viscosity of 3.85 and phosphorous acid.

EXAMPLE 16 (INVENTION)

The process according to Example 15 using orthophosphoric acid in place of phosphorous acid.

EXAMPLE 17 (COMPARISON)

17 dtex PA 6 fibers of Polymer 3 having 11 crimps per cm and a relative solution viscosity of 4.46, without solid phase condensation, are spun from a high molecular weight Polyamide extrusion granulate having a relative solution viscosity of 5.02 which can no longer be spun industrially into fibers.

EXAMPLE 18 (COMPARISON)

17 dtex PA 6.6 fibers of Polymer 4 having 11 crimps per cm and a relative solution viscosity of 3.07.

EXAMPLE 19 (INVENTION)

17 dtex PA 6.6 fibers of Polymer 4 having 11 crimps per cm and a relative solution viscosity of 3.07 are treated with an aqueous solution of orthophosphoric acid (fiber/water ratio 1:20) without wetting agent for 30 minutes at 95° C. The quantity of acid used is 0.2% by weight, based on the fibers to be solid phase condensed. After filtration and air drying, solid phase condensation is carried out for 8 hours at 170° C. under vacuum.

EXAMPLE 20

The process according to Example 19 using phosphorous acid in place of orthophosphorous acid.

TABLE 1

Solid phase condensation of polyamide 6 fibers of Polymer 1 with 11 crimps/cm and Comparison Examples

| Example No. | PA-Fibre | Catalyst | t[1] (h) | Titre (dtex) | $\eta_{rel}$[2] | Tenacity[3] (cN/dtex) | Elongation[4] (%) | Breaking work[5] (cN · cm) | $T_7$[6] (cN) | DST[7] |
|---|---|---|---|---|---|---|---|---|---|---|
| 1 | TM 26 R | — | 0 | 17.25 | 3.36 | 5.30 | 6.30 | 37.82 | 11.16 | 42 555 |
| (Comparison) | | | 8 | 16.99 | 4.05 | 5.69 | 73.73 | 46.38 | 12.69 | 44 241 |
| | | | 16 | 17.28 | 4.23 | 5.15 | 70.56 | 41.58 | 11.96 | 63 002 |
| | | | 24 | 17.29 | 4.48 | 4.94 | 73.29 | 42.37 | 11.47 | 47 312 |
| 2 | TM 26R | $H_3PO_4$ | 8 | 17.89 | 7.26 | 5.21 | 74.20 | 46.46 | 12.61 | 113 872 |
| | | | 16 | 16.84 | 7.18 | 5.39 | 70.21 | 41.16 | 11.93 | 66 979 |
| | | | 24 | 17.56 | 9.57 | 4.89 | 71.32 | 40.29 | 11.18 | 84 756 |
| 3 | TM 26R | $H_3PO_3$ | 8 | 17.40 | 8.12 | 5.54 | 80.26 | 51.81 | 12.52 | 79 451 |
| | | | 16 | 16.56 | 8.76 | 5.34 | 72.98 | 43.32 | 12.31 | 69 772 |
| | | | 24 | 16.78 | 10.01 | 5.59 | 78.11 | 48.41 | 12.42 | 113 593 |
| 4 | TM 26R | $NaH_2PO_4$ | 8 | 17.32 | 6.35 | 5.72 | 81.57 | 52.64 | 12.12 | 82 620 |
| | | | 16 | 16.54 | 6.92 | 5.71 | 79.03 | 49.26 | 11.88 | 84 028 |
| | | | 24 | 17.60 | 7.25 | 5.15 | 80.07 | 48.87 | 11.51 | 87 859 |
| 17 (Comparison) | TM 26 high viscosity | — | 0 | 18.31 | 4.46 | 6.63 | 58.47 | 45.78 | 16.06 | |

TABLE 2

Solid phase condensation of polyamide 6 fibers of Polymer 2 with 11 crimps/cm and Comparison Examples

| Example No. | PA-Fibre | Catalyst | t[1] (h) | Titre (dtex) | $\eta_{rel}$[2] | Tenacity[3] (cN/dtex) | Elongation[4] (%) | Breaking work[5] (cN · cm) | $T_7$[6] (cN) | DST[7] |
|---|---|---|---|---|---|---|---|---|---|---|
| 5 | TM 26-R | — | 0 | 18.19 | 3.72 | 5.17 | 90.51 | 54.59 | 9.94 | 87 467 |
| (Comparison) | | | 8 | 18.03 | 4.48 | 4.79 | 85.67 | 49.83 | 10.82 | 90 970 |
| 6 | TM26 2R-1 | $H_3PO_3$ | 8 | 17.88 | 8.24 | 4.88 | 89.37 | 52.46 | 10.53 | 105 392 |
| 7 | TM26 2R-1 | $H_3PO_4$ | 8 | 18.41 | 8.28 | 5.01 | 96.81 | 59.87 | 10.61 | 115 718 |
| 8 | TM26 2R-2 | — | 0 | 17.42 | 3.86 | 4.96 | 84.73 | 46.12 | 9.18 | 111 594 |
| (Comparison) | | | 8 | 19.26 | 6.29 | 4.73 | 87.09 | 51.89 | 10.01 | 109 037 |
| 9 | TM26 2R-2 | $H_3PO_3$ | 8 | 18.40 | 9.47 | 4.69 | 92.41 | 52.57 | 10.48 | 122 101 |
| 10 | TM26 2R-2 | $H_3PO_4$ | 8 | 17.40 | 8.28 | 4.87 | 91.65 | 52.16 | 9.75 | 119 096 |
| 11 | TM26 2R-3 | — | 0 | 17.08 | 3.88 | 5.36 | 68.23 | 39.26 | 10.95 | 106 830 |
| (Comparison) | | | 8 | 18.04 | 6.04 | 5.40 | 70.37 | 44.08 | 11.71 | 168 625 |
| 12 | TM26 2R-3 | $H_3PO_3$ | 8 | 17.07 | 10.14 | 5.25 | 76.74 | 45.11 | 11.12 | 278 031 |
| 13 | TM26 2R-3 | $H_3PO_3$ | 8 | 17.86 | 9.13 | 5.12 | 69.23 | 40.32 | 10.89 | 239 269 |
| 14 | TM26 2R-4 | — | 0 | 18.13 | 3.85 | 5.00 | 70.46 | 39.48 | 11.06 | 69 606 |
| (Comparison) | | | 8 | 16.30 | 5.89 | 5.75 | 70.08 | 41.15 | 10.54 | 174 260 |
| 15 | TM26 2R-4 | $H_3PO_3$ | 8 | 17.54 | 7.96 | 5.08 | 79.45 | 47.38 | 10.22 | |
| 16 | TM26 2R-4 | $H_3PO_4$ | 8 | 18.03 | 8.11 | 5.20 | 80.01 | 47.85 | 11.20 | 190 993 |

TABLE 3

Solid phase condensation of polyamide 6.6 fibers of Polymer 4 with 11 crimps/cm and Comparison Examples

| Example No. | PA-Fibre | Catalyst | t[1] (h) | Titre (dtex) | $\eta_{rel}$[2] | Tenacity[3] (cN/dtex) | Elongation[4] (%) | Breaking work[5] (cN · cm) | $T_7$[6] (cN) | DST[7] |
|---|---|---|---|---|---|---|---|---|---|---|
| 18 | T 310 | — | 0 | 15.90 | 3.07 | 5.12 | 104.50 | 55.42 | 12.05 | 21 562 |
| (Comparison Example 7) | | | | | | | | | | |
| 19 | T 310 | $H_3PO_4$ | 8 | 16.99 | 6.11 | 4.43 | 107.75 | 55.59 | 12.89 | 28 544 |
| 20 | T 310 | $H_3PO_3$ | 8 | 17.07 | 6.30 | 4.57 | 108.16 | 57.53 | 13.52 | 41 158 |

Notes on Tables 1 to 3:
[1]Solid phase condensation time.
[2]Relative viscosity according to DIN 53 727 at 20° C.
[3]Fineness-related maximum tensile stress according to DIN 53 816.
[4]Elongation at break according to DIN 53 816.
[5]Integral of tensile strength at break × elongation at break.
[6]Tenacity at an elongation of 7%.
[7]Wire abrasion resistance determined by loading the fibers with a specified weight and passing them back and forth over a tungsten wire. The number of turns until breakage is a measure of the abrasion resistance.

What we claim is:

1. A process for the production of ultra-high molecular weight polyamide fibers comprising impregnation of normal viscosity polyamide fibers with a solution of a solid phase condensation catalyst to form impregnated fibers, drying said impregnated fibers, and thermal solid phase condensation of said impregnated fibers in the absence of oxygen and below the melting point of the polyamide in said normal viscosity fibers.

2. The process of claim 1 wherein said normal viscosity fibers have a relative solution viscosity in $H_2SO_4$ of a maximum of about 4.2.

3. The process of claim 2 wherein said viscosity is a maximum of about 4.0.

4. The process of claim 3 wherein said viscosity is about 3.4 to about 3.8.

5. The process of claim 3 wherein said viscosity is about 3.8.

6. The process of claim 1 wherein said normal viscosity fibers are of polyamide derived from ω-aminocarboxylic acids having 4 to 12 carbon atoms, lactams having 4 to 12 carbon atoms, aliphatic diamines having 4 to 12 carbon atoms and aliphatic dicarboxylic acids having 5 to 12 carbon atoms, or mixtures thereof.

7. The process of claim 6 wherein said polyamide is selected from the group consisting of PA 4; PA 4,6; PA 6; PA 6,6; PA 6,10; PA 11; PA 12; PA 12,12, and mixtures thereof.

8. The process of claim 1 wherein said condensation catalyst is present in a catalyst amount of a maximum of about 0.5% by weight based on said normal viscosity fibers.

9. The process of claim 8 wherein said catalyst amount is about 0.1% to about 0.3% by weight based on said normal viscosity fibers.

10. The process of claim 9 wherein said catalyst amount is about 0.2% by weight based on said normal viscosity fibers.

11. The process of claim 1 wherein said condensation is carried at a condensation temperature of 160° to 200° C.

12. The process of claim 11 wherein said condensation temperature is 170° to 190° C.

13. The process of claim 1 wherein said condensation is carried out under an inert atmosphere.

14. The process of claim 1 wherein said condensation is carried out under a vacuum.

15. The process of claim 1 wherein said condensation is carried out for a time of 5 to 48 hours.

16. The process of claim 15 wherein said time is 6 to 24 hours.

17. The process of claim 16 wherein said time is 8 to 12 hours.

18. The process of claim 1 wherein said impregnated fibers are solid phase condensed to a final relative viscosity of at least 7.0.

19. The process of claim 18 wherein said final relative viscosity is at least 9.0.

20. The process of claim 1 wherein said condensation catalyst is at least one inorganic phosphorous compound.

21. The process of claim 20 wherein said phosphorous compound is selected from the group consisting of phosphorous acid, orthophosphoric acid, salts of phosphorous acid, salts of orthophosphoric acid, esters of phosphorous acid, and esters of orthophosphoric acid.

22. The process of claim 20 wherein said phosphorous compound is selected from the group consisting of $H_3PO_4$, $H_3PO_3$, $Na_2HPO_4.12H_2O$, $Na_2HPO_3.5H_2O$, and $NaH_2PO_4$.

23. The process of claim 1 wherein said solution of said catalyst is aqueous.

24. The process of claim 1 wherein said condensation is carried out continuously.

25. The process of claim 1 wherein said condensation is carried out batchwise.

* * * * *